US005109785A

United States Patent [19]

Inoue et al.

[11] Patent Number: 5,109,785

[45] Date of Patent: May 5, 1992

[54] WORKPIECE FABRIC FEEDING DEVICE FOR BINDER STRIP SEWING MACHINE

[75] Inventors: Kazushi Inoue, Aichi; Shigeru Abe, Kakamigahara; Yuji Tagawa, Nagoya; Takashi Kondo, Oobu; Yasuhiko Watanabe, Ibi; Jun Shibata, Nagoya, all of Japan

[73] Assignee: Brother Kogyo Kabushiki Kaisha, Nagoya, Japan

[21] Appl. No.: 584,165

[22] Filed: Sep. 18, 1990

[30] Foreign Application Priority Data

Sep. 25, 1989 [JP] Japan ..... 1-249482

[51] Int. Cl.[5] ..... D05B 35/06

[52] U.S. Cl. ..... 112/303; 112/121.11; 112/70; 112/113

[58] Field of Search ..... 112/65, 68, 70, 121.11, 112/121.12, 121.15, 104, 113, 147, 303

[56] References Cited

U.S. PATENT DOCUMENTS

| | | | |
|---|---|---|---|
| 3,747,544 | 7/1973 | Nicolay et al. | 112/65 |
| 3,980,030 | 9/1976 | Fischer et al. | 112/65 X |
| 4,034,689 | 7/1977 | Hintzen et al. | 112/68 |
| 4,481,895 | 11/1984 | Asao et al. | 112/68 X |
| 4,711,188 | 12/1987 | Yoneda | 112/104 |

*Primary Examiner*—Peter Nerbun
*Attorney, Agent, or Firm*—Oliff & Berridge

[57] ABSTRACT

A feeding device for independently feeding, by a preparatory device, a binder strip and flap strips to a garment held by a base presses. There are eight types of combination in feeding fashions, whether or not the binder strip is to be fed, whether or not one flap strip is to be fed, and whether or not another flap strip is to be fed ($2^3=8$). Various feeding fashions are provisionally set in order prior to actual sewing, and control means controls actual operations of the preparatory device in accordance with the feeding fashions and every feeding fashions.

4 Claims, 7 Drawing Sheets

○ ..... SUPPLY
× ..... NON-SUPPLY

| | LEFT FLAP STRIP W3 | BINDER STRIP W2 | RIGHT FLAP STRIP W4 |
|---|---|---|---|
| ① | × | × | × |
| ② | ○ | ○ | ○ |
| ③ | ○ | ○ | × |
| ④ | × | ○ | ○ |
| ⑤ | × | ○ | × |
| ⑥ | ○ | × | ○ |
| ⑦ | ○ | × | × |
| ⑧ | × | × | ○ |

FIG. 4

○ ..... SUPPLY
× ..... NON-SUPPLY

| | LEFT FLAP STRIP W3 | BINDER STRIP W2 | RIGHT FLAP STRIP W4 |
|---|---|---|---|
| ① | × | × | × |
| ② | ○ | ○ | ○ |
| ③ | ○ | ○ | × |
| ④ | × | ○ | ○ |
| ⑤ | × | ○ | × |
| ⑥ | ○ | × | ○ |
| ⑦ | ○ | × | × |
| ⑧ | × | × | ○ |

WORKPIECE FABRIC FEEDING DEVICE FOR BINDER STRIP SEWING MACHINE

BACKGROUND OF THE INVENTION

The present invention relates to a binder strip sewing machine in which a binder strip and at least one flap strip are integrally held on a garment on a sewing machine table, and these strips are sewn to the garment. More particularly, the invention relates to a workpiece fabric feeding device for use in the binder strip sewing machine for selectively feeding the binder strip and the flap strip onto the garment.

Throughout inhouse R & D activities, the present inventors have proposed a workpiece fabric feeding device for use in a binder strip sewing machine. According to the inhouse proposal, a garment, a binder strip and right and left flap strips are integrally installed on the sewing machine. (This inhouse proposal is disclosed in a Japanese Utility Model Application No. 1-86649). More specifically, in the fabric feeding device, base presses are provided for pressurizingly holding the garment onto a sewing machine table. Further, a binder strip transferring member is provided for supplying the binder strip onto the garment, and a pair of folding plates are provided for folding the binder strip and maintaining the thus folded binder strip on the garment in cooperation with the binder strip transferring member. Futhermore, there are provided fabric piece transferring members for supplying right and left flap strips over the folded sections of the binder strip, and fabric holding members for holding the thus supplied flap strips on the binder strip.

A switch on a control panel is manipulated by an operator prior to an actual sewing operation so as to set a supply of the left and/or right flap strips onto the garment. Therefore, one feeding fashion is determined by the combination of the supply or non-supply of the flap strips. When the fabric feeding device is actuated, strip(s) in accordance with the one feeding fashion given by the one combination of the strips is supplied to the garment. Thereafter, the thus fed strip together with the garment are fed to an actual sewing region.

However, according to the thus proposed fabric feeding device, various kinds of strip feedings cannot be easily performed. If another kind of fabric feeding fashion is contemplated after the actual sewing with respect to the one feeding fashion is completed, the operator must again manipulate the switch of the control panel in order to alter the fabric feeding fashion. For example, in a first feeding fashion, the left flap strip is to be supplied for sewing, on the other hand, in a second feeding fashion, both left and right strips are to be fed for sewing. In such a case, the operator must again manipulate the control panel upon completion of the sewing with the first feeding fashion.

SUMMARY OF THE INVENTION

It is therefore, an object of the present invention to overcome the above described drawbacks and to provide an improved workpiece fabric feeding device for use in a binder strip sewing machine in which various feeding fashions can be set in order prior to actual sewing, and a binder strip as well as flap can be automatically fed in accordance with the orders of the present feeding fashions for sewings.

These and other objects of the present invention will be attained by providing a workpiece fabric feeding device for use in a binder strip sewing machine, the sewing machine including a table on which a garment (W1) is held, and a stitching mechanism for stitching at least one of a binder strip (W2) and flap strips (W3, W4) those selectively fed by the workpiece fabric feeding device to the garment (W1), and the workpiece fabric feeding device comprising a preparatory device for independently positioning at least one of the binder strip and the flap strips onto a predetermined position of the garment and for integrally feeding the garment and the thus positioned at least one of the binder strip and the flap strips to the stitching mechanism, setting means for setting a plurality of feeding fashions given by combinations of the binder strip and flap strips, and control means for controlling the preparatory device in order to execute sewing programs in accordance with the feeding fashions set in the setting means.

The setting means set various feeding fashions given by combinations of the binder strip and the two flap strips, and orders of these feeding fashions can also be set in the setting means. The control means contains various data for operation timings of the preparatory device, each of the data corresponding to each of the feeding fashions. The control means reads the feeding fashions and controls the operation of the preparatory device. The reading and control to the preparatory device are performed successively in accordance with the order of the feeding fashions.

BRIEF DESCRIPTION OF THE DRAWINGS

In the drawings;

FIG. 4 is a view for description of various feeding fashions and for illustrating visual displays therefor;

DETAILED DESCRIPTION OF THE PREFERRED EMBODIMENT

A workpiece fabric feeding device for a binder strip sewing machine according to a first embodiment of this invention will be described with reference to accompanying drawings.

Figure 1:
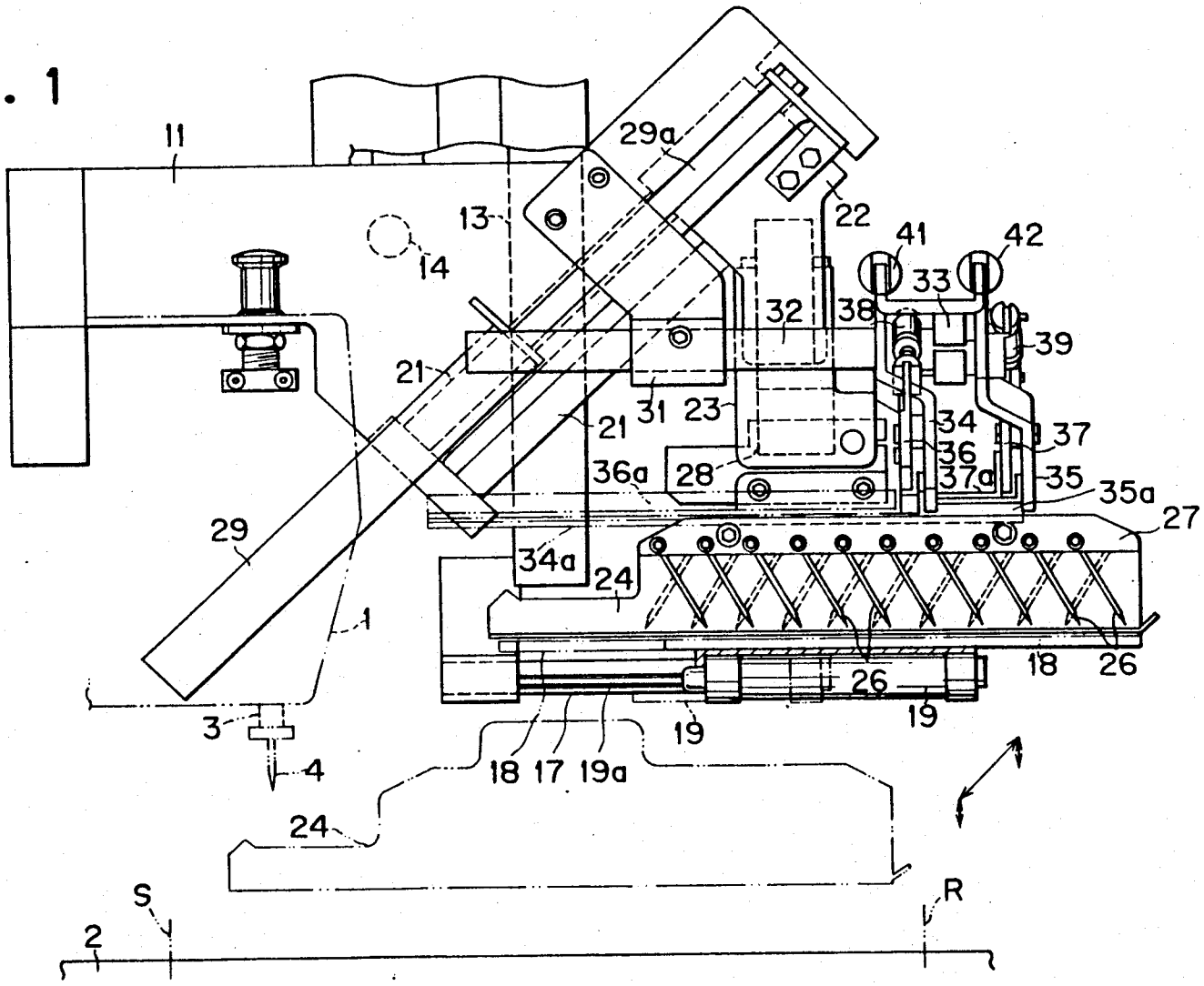
FIG. 1 is a side elevational view showing a workpiece fabric feeding device according to one embodiment of the present invention.
Figure 2:
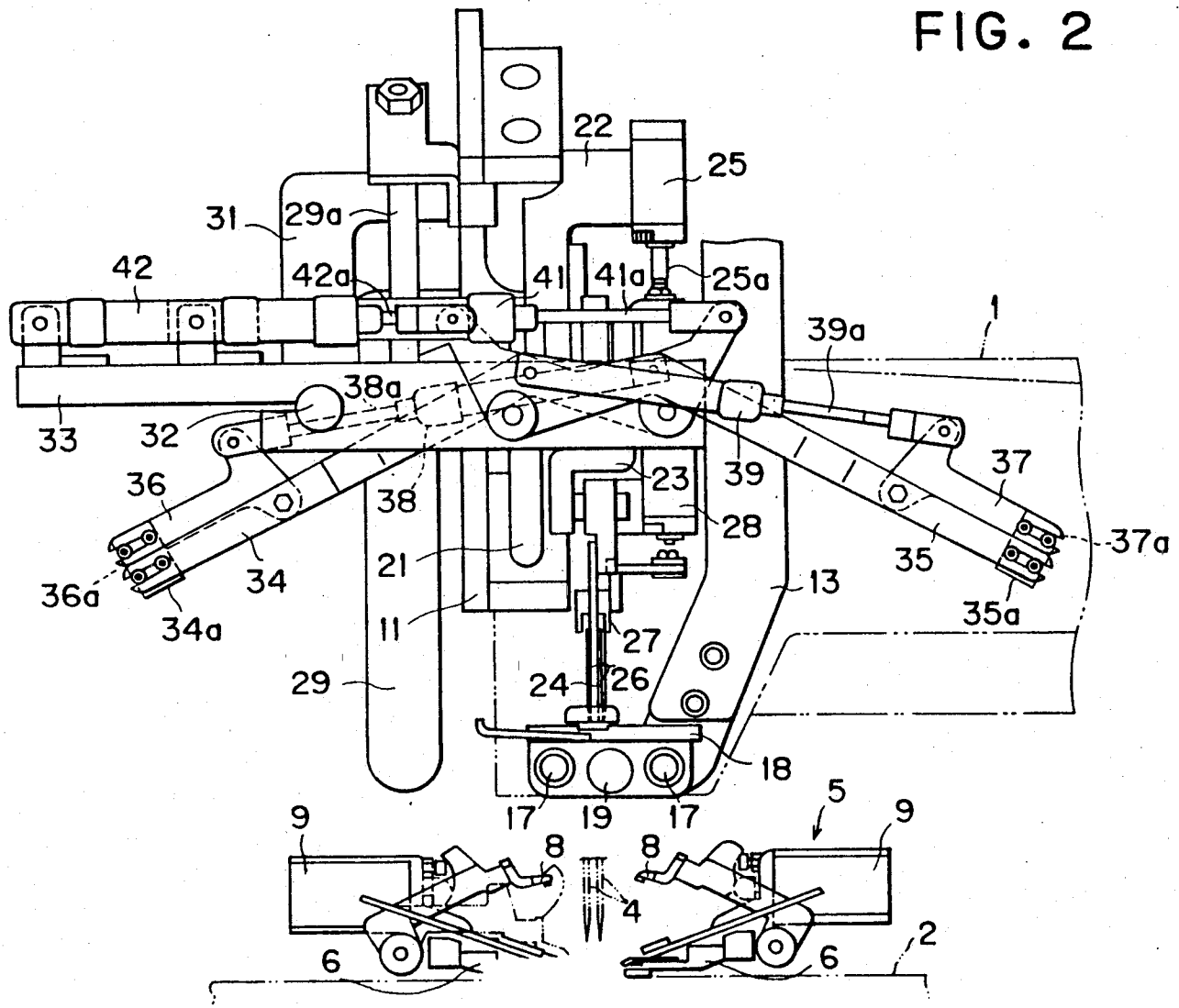
FIG. 2 is a front elevational view of the feeding device.

Referring first to a mechanical arrangement of the workpiece fabric feeding device, as shown in FIGS. 1 and 2, a sewing machine main body 1 having an arm portion is mounted on a sewing machine table 2, and a needle bar 3 is vertically movable provided to the arm portion. Two needles 4 are attached to a lower portion of the needle bar 3.

A clamp unit 5 is movably provided on the sewing machine table 2 as shown in FIG. 2. The clamp unit 5 is linearly movable between a standby position R at a position frontwardly relative to the needle 4 as shown in FIG. 1, and a stiching position S (FIG. 4) at a position adjacent the needle 4. The clamp unit 5 is well known in the art and has a pair of base presses 6, a pair of folding plates 7, and a pair of flap presses 8 as shown in FIG. 2. As best shown in FIG. 6(*j*), the pair of base presses 6 are vertically movable and adapted to press and hold a garment W1 onto the upper surface of the table 2. The pair of folding plates 7 are movable toward and away from each other in a generally horizontal plane for folding a binder strip W2 mounted on the garment W1 along two lines on the binder strip in parallelism, and for maintaining the thus folded binder strip on the garment W1. The flap presses 8 are vertically movable for pressing and holding a pair of flap fabrics W3 and W4 positioned over the binder strip W2 onto the folding plates 7. As shown in FIG. 2, each of the flap presses 8 is coupled to each one of pneumatic cylinders 9 for its vertical movement. The flap fabrics or strips W3 and W4 are normally stacked on flap strip mounting tables (not shown) positioned in the vicinity of transferring arms 34 and 35 described below.

Next, description is given to a workpiece fabric feeding device for feeding the binder strip W2 and the pair of right and left flap fabrics W3, W4 toward and over the pair of base presses 6. In FIGS. 1 and 2, a support plate 11 is attached to the arm portion of the sewing machine main body 1. The support plate 11 has an upper portion which pivotally supports a swing arm 13. The pivotal movement of the swing arm 13 is defined between a transfer position shown by a solid line in FIG. 2 and a standby or rest position as shown in FIG. (*a*). Further, the upper portion of the support plates 11 mounts thereon a first pneumatic cylinder 14 coupled to the swing arm 13 for pivotally moving the latter between the transfer and the rest positions.

The swing arm 13 has a lower end portion attached with a pair of guide shafts 17 extending in the moving direction of the clamp unit 5. Further, a binder strip stand 18 is reciprocally movably provided on the pair of guide shafts 17 for mounting the binder strip W2 on the stand 18. At a position between the guide shafts 17, a second pneumatic cylinder 19 is provided whose piston rod 19*a* is connected to the swing arm 13 for reciprocally moving the binder strip stand 18.

The support plate 11 also mounts thereon a pair of guide rods 21 obliquely extending from a position above the front portion of the sewing machine main body 1 toward the main body 1 (see FIG. 1). A support member 22 is vertically movably supported to the pair of guide rods 21. Further, a slider member 23 is vertically slidably provided to the support member 22. The lower portion of the slider member 23 is provided with a binder strip transferring member 24 having an inverted T-shape cross-section and confrontable against the binder strip stand 18. A third pneumatic cylinder 25 is mounted on the support member 22 for integrally vertically moving the slider member 23 and the binder strip transferring member 24. A piston rod 25*a* of the third cylinder 25 is coupled to the slider member 23.

At both side portions of the binder strip transferring member 24, provided are a plurality of trapping needles 26 protrudable from and retractable into a lower surface of the transferring member 24. These trapping needles 26 are supported by a link plate 27 connected to fourth pnuematic cylinder 28. Therefore, the needles 26 are integrally moved in the vertical direction while the binder strip W2 is mounted on the binder strip stand 18, so that the needles 26 thrust into the binder strip W2 to permit the binder strip W2 to be trapped by the binder strip transferring member 24.

Further, the support plate 11 also mounts thereon a fifth pneumatic cylinder 29 extending in an axial direction of the guide rod 21. A piston rod 29*a* of the fifth cylinder 29 is connected to the support member 22. In accordance with the actuation of the fifth pneumatic cylinder 29, the support member 22, the slider member 23 and the binder strip transferring member 24 are moved along the guide rod 21 and between upper and lower positions corresponding to upper and lower end portions off the guide rod 21. Furthermore, at each of the upper and lower positions, the slider member 23 and the binder strip transferring member 24 are moved between their ascent and descent positions upon actuation of the third pneumatic cylinder 25 coupled to the slider member 23.

Moreover, a binder strip trapping position is defined for trapping the binder strip W2 on the binder strip stand 18. The trapping position corresponds to the descent position of the binder strip transferring member 24 when the fifth pneumatic cylinder 29 is actuated to move the member 24 to the position corresponding to the upper end portion of the guide rod 21. Further, a binder strip release position is defined for releasing the trapped binder strip W2 on the base presses 6. The releasing position corresponds to the descent position of the binder strip transferring member 24 when the fifth pneumatic cylinder 29 is actuated to move the member 24 to the position corresponding to the lower end portion of the guide rod 21.

A support arm 31 extends from the support plate 11, and a support shaft 32 is insertedly supported by the support arm 31 and extends in the moving direction of the clamp unit 5. A support table 33 is provided to a front end portion of the support shaft 32 at a position frontwardly relative to the slider member 23. A pair of right and left transferring arms 34 and 35 are pivotally supported at their upper portion to the support table 33. Further, operation arms 36 and 37 are openably and closably provided to free end portions of the transferring arms 34 and 35, respectively. Furthermore, clamp pieces 34*a*, 35*a*, 36*a* and 37*a* are attached at their one ends to the transferring arms 34 35 and the operation arms 36 and 37, respectively. The clamp pieces have their lengths approximately equal to a length of the binder strip transferring member 24. In accordance with the opening and closing motions of the operation arms 36 and 37 relative to the transferring arms 34 and 35, the right and left flap strips W3 and W4 are interposedly clamped by the clamp pieces 34*a* and 36*a* and by the clamp pieces 35*a* and 37*a*.

Sixth and seventh pneumatic cylinder 38 and 39 are respectively connected to the transferring arms 34 and 35 for opening and closing the operation arms 36 and 37 with respect thereto. These cylinders 38 and 39 have piston rods 38*a* and 39*a* connected to the operation arms 36 and 37, respectively. Further, eigth and ninth cylinders 41 and 42 are mounted on the support table 33, and piston rod 41*a* and 42*a* of these cylinders are respectively connected to the transferring arms 34 and 35. In accordance with the actuations of the eighth and ninth pneumatic cylinders 41, 42, each of the transferring arms 34 and 35 will be reciprocally moved between flap strip clamping positions and stitch preparatory positions. In the flap strip clamping positions, the transferring arms 34, 35 clamp the right and left flap strips W3 and W4 at the upper side portions of the binder strip stand 18, and in the switch preparartory positions, the clamped flap strips W3, W4 are supplied onto the binder strip W2 positioned over the pair of base presses 6.

Incidentally, the above described clamp unit 5, the swing arm 13, the binder strip stand 18, the binder strip transferring member 24, the transferring arms 34, 35, the operation arms 36, 37 and various pneumatic cylinders for driving these components will consitute a preparatory device M for independently supplying the binder strip W2 and the flap strips W3 and W4 to a predetermined position of the garment W1, and for setting these fabrics to a predetermined portion of the sewing machine for the purpose of ultimate stiching.

Next, an electrical arrangement available for the fabric feeding device according to this invention will be described.

Figure 3:
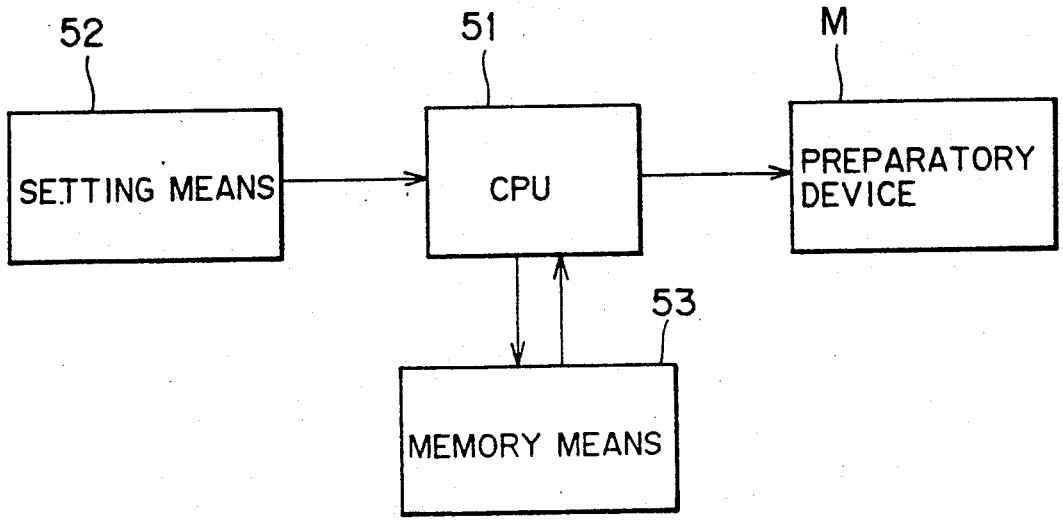
FIG. 3 is a block diagram showing an electrical arrangement in the feeding device.

As shown in FIG. 3, the fabric feeding device includes a central processing unit (CPU) 51 having an output side connected to the above described various pneumatic cylinders of the preparatory device M through electromagnetic valves (not shown) and having an input inside connected to a setting means 52 for setting various fabric feeding fashions toward the stitching mechanism of the sewing machine said fashions being given by various combinations of the binder strip W2 and the flap strips W3 and W4. In other words, the setting means 52 sets the various kinds of combinations to be supplied among the binder strip W2 and the flap strips W3 and W4 onto the garment W1. Further, the CPU 51 is accessively connected with a memory means 53 in which the feeding fashion given by the setting means 52 is stored.

Regarding the setting means 52, eight types of combinations are conceivable. That is, two types of feeding are conceivable (feeding or not feeding) with respect to each of the binder strip W2, the left and right flap strips W3 and W4. Accordingly, resultant feeding fashions becomes $2^3=8$ types (see FIG. 4 where X designates non-feeding, and O designates positive feeding). In the memory means 53, control data are provisionally stored for independently controlling operational timings of each of the pheumatic cylinders of the preparatory device M, so that one of the eight types of feeding fashions can be attained. Furthermore, a memory region is also provided in the memory means 53 for storing therein the eight types of combinations (No. 1 through 8 in FIG. 3) and execution programs therefor.

Figure 5:
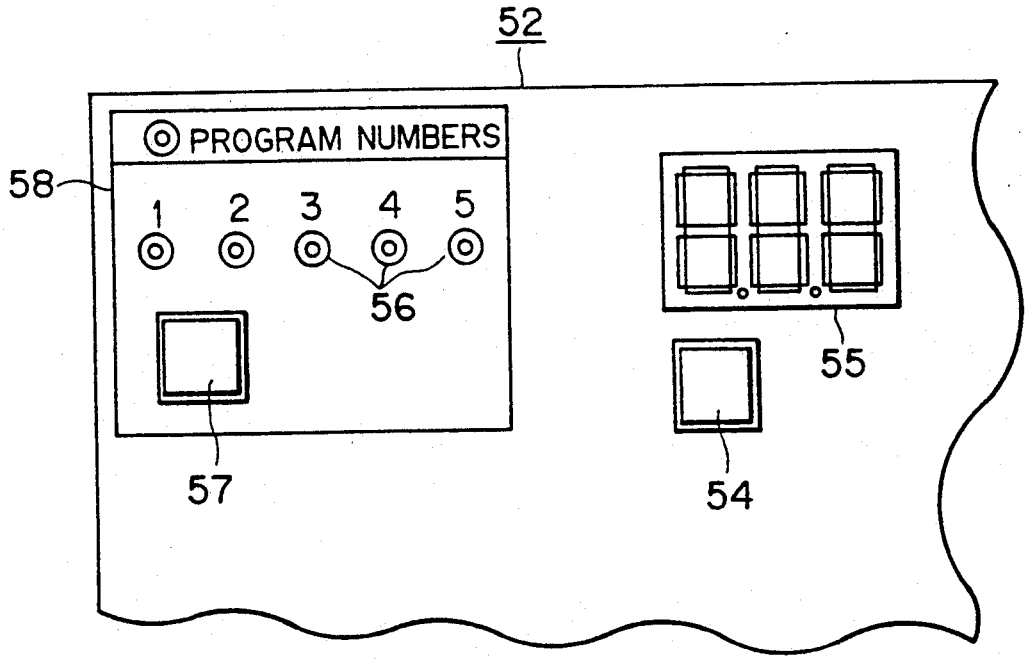
FIG. 5 is a front view showing a setting means in the workpiece fabric feeding device according to one embodiment of this invention.
Figure 6A:
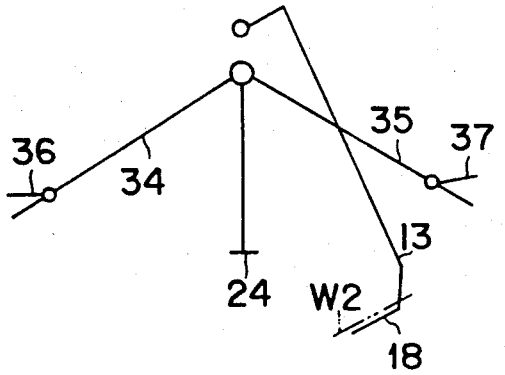
FIG. 6(*a*) through 6(*k*) are views for description of various operational phase according to one embodiment of this invention.
Figure 6B:
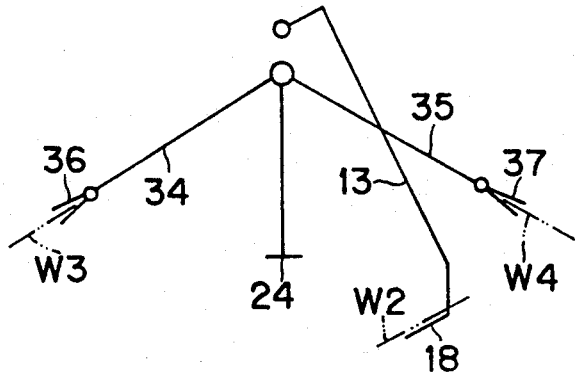
Figure 6C:
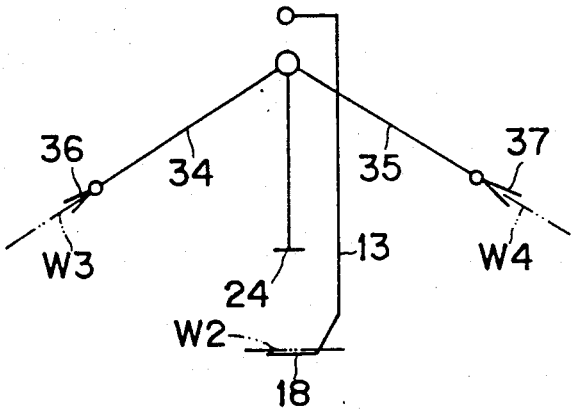
Figure 6D:
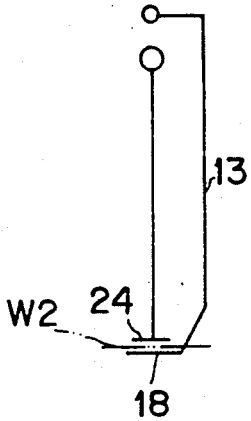
Figure 6E:
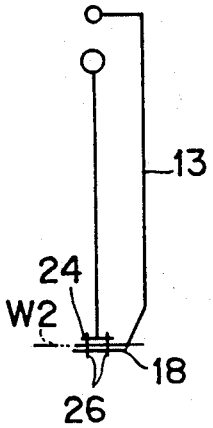
Figure 6F:
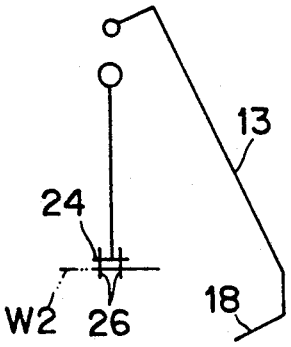
Figure 6G:
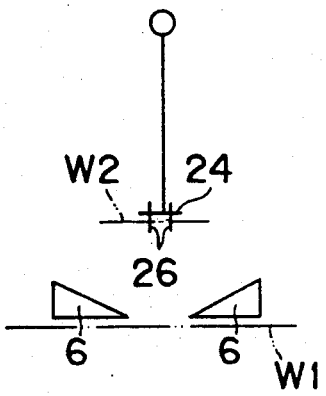
Figure 6H:
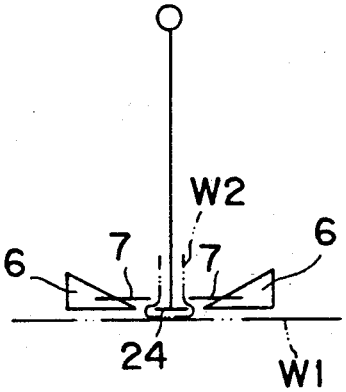
Figure 6I:
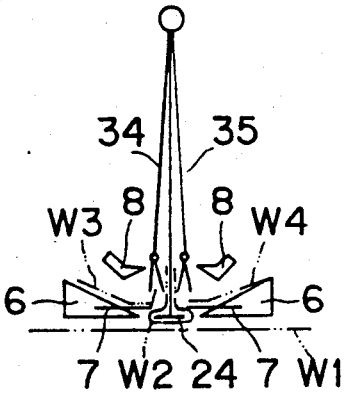
Figure 6J:
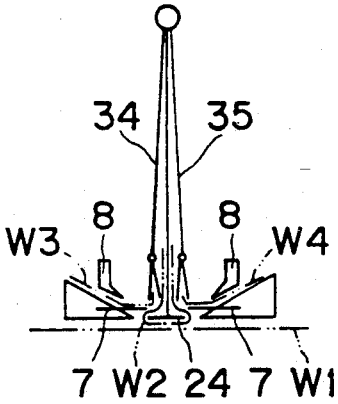
Figure 6K:
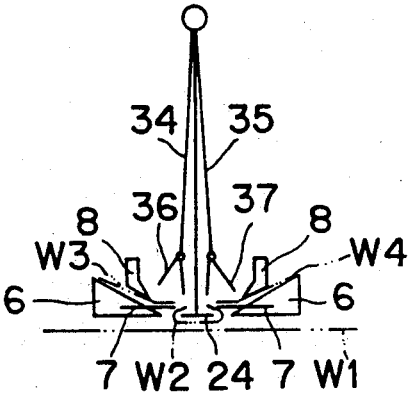

As shown in FIG. 5, the setting means 52 has a front panel where provided are a setting button 54 for selecting one of the feeding fashions among the eight combinations, and a display portion 55 for acknowledging the selected feeding fashion. The display portion 55 is constituted by three sections each section being arranged by seven light emitting diodes (LED), whose selective light emission indicates one of the feeding fashions as shown in FIG. 4. That is, if only a horizontal LED of each of the sections is turned ON, the binder strip or the flap strip is not sujected to feeding, whereas if at least two vertically arrayed LEDs and upper and lower LEDs are turned ON, the strip undergoes feeding.

Upon electrical power supply, in the setting means 52, initialized is the non-supply condition of the binder strip W2 nor right and left flap strips W3 and W4. Therefore, the display portion 55 displays the light emitting mode shown in No. 1 of FIG. 4. Then, if the setting button 54 is depressed once, the dislay portion 55 displays feeding indications of binder strip W2 and the right and left flap strips W3 and W4 as shown in No. 2 of FIG. 4. Similarly, upon every depression of the setting button 54, the display porion 55 will successively display No. 3 fashion through No. 8 fashion in order, and then return to No. 1 fashion.

Further, the front panel of the setting means 52 is also provided with a program setter 58 for setting the execution program of the above feeding fashions. The program setter 58 includes five circular light emitting diodes 56 and a single determination button 57. Upon electrical power supply, one LED 56-1 is only turned ON, which is indicative of standby state for performing a first feeding fashion selected by the setting button 54. In this state, if one of the feeding fashions is selected by the setting button 54, and then, the determination button 57 is depressed, this selected feeding fashion is fixed for the first execution of feeding, and the fixed feeding fashion is stored in the data memory region of the memory means 53 through the CPU 51. Thereafter, the first LED 56-1 is turned OFF and the second LED 56-2 is turned ON which is indicative of standby state for performing the next feeding fashion selected by the setting button 54. Likewise, five execution programs can be set maximum. Upon completion of fifth setting by the determination button 57, the first LED 56-1 is again turned ON for again setting an execution program attendant to one selected feeding fashion.

Incidentally, the CPU 51 and the memory means 53 will constitute control means for controlling the preparatory device M in accordance with the provisionally stored execution program and in accordance with the feeding fashion selected by the setting means 52.

Next, operation modes of the fabric feeding device in accordance with the present invention will be described in detail with particular reference to FIGS. 6(*a*) through 6(*j*) and FIG. 7.

FIG. 6(*a*) shows a state before fabric feeding. In this state, the swing arm 13 has a standby or rest position, and at the same time, the binder strip stand 18 has a rearwardly retracted position. Further, as shown in FIG. 1, the support member 22 is positioned at the upper end portion of the guide shaft 21, and the slider member 23 and the binder strip transferring member 24 are positioned at their standby positions which are positioned higher than the positions of the slider member 23 and the transferring member 24 shown in FIG. 1. Furthermore, the pair of transferring arms 34 and 35 are positioned at their upper clamping positions, and at the same time, the corresponding operation arms 36 and 37 are held in their opening positions with respect to the transferring arms 34 and 35, respectively. Moreover, the garment W1 is held on the sewing machine table 2 by the pair of base presses 6. With this state, the binder strip W2 may be mounted on the binder strip stand 18, if desired.

Provided that an operator manipulates the setting means 52 four times so as to select the fabric feeding fashion in the order of No. 2, No. 5, No. 6 and No. 2 in FIG. 4, and in which fifth setting has not been made, then operations of the fabric feeding device and the binder strip sewing machine are started. With this operational start, as shown in FIG. 7, in step S1, the CPU 51 performs accessing to the data memory region of the memory means 53, and detects the No. 2 feeding fashion for the first execution program. Further, the CPU 51 comprises a first, second, and third judging means for judging a necessity for supply of the first flap strip, binder strip, and second flap strip, respectively. Specifically, the CPU 51 reads the control data stored in the memory means 53 which control data is available for the execution of No. 2 feeding fashion. In accordance with this reading, the CPU 51 controls the preparatory device M as follows (according to No. 2 feeding fashion, the binder strip W2 and right and left flap strips W3 and W4 must be supplied as is apparent from FIG. 4):

Firstly, in the CPU 51, determination is made as to whether or not the supply of the flap strips W3 and W4 are set in Step S2. In the No. 2 feeding fashion, the CPU 51 must send signals to the preparatory device M so as to perform preparation of supplies of the flap strips W3 and W4 in Step S5. More specifically, the CPU 51 controls the sixth and seventh pneumatic cylinders 38 and 39 for closing the operation arms 36 and 37. In this case, the right and left flap strips W3 and W4 stored on the flap strip tables (not shown) are clamped by the clamp pieces 34*a* and 36*a* and by the clamp pieces 35*a* and 37*a* as shown in FIG. 6(*b*).

Then, in Step S7, determination is made as to whether or not the supply of the binder strip W2 is set. In case of the No. 2 fabric feeding fashion, the determination falls YES, so that the CPU 51 controls the preparatory device M so as to supply the binder strip W2 in Step S8. More specifically, the CPU 51 controls the first pneumatic cylinder 14, so that the swing arm 13 is angularly moved in one direction (clockwise direction in FIG. 6(*c*)), to therby position the binder strip stand 18 at a position below the binder strip transferring member 24. Simultaneously, the second pneumatic cylinder 19 is actuated to move the binder strip stand 18 from its retracted position shown by two dotted chain lines in FIG. 1 to its operating position, so that the binder strip stand 18 confronts the binder strip transferring member 24 as shown in FIG. 6(*c*).

Subsequently, the third pneumatic cylinder 25 is actuated so as to move the binder strip transferring member 24 to its descent position on the binder strip stand 18 as shown in FIG. 6(*d*), and then, the fourth pneumatic cylinder 28 is actuated to project the binder strip trapping needles 26 from the lower surface of the transferring member 24, to thereby hold the binder strip W2 on the binder strip stand 18 by the needles 26 as shown by FIG. 6(*e*).

Then, the third pneumatic cylinder 25 is actuated to move the binder strip transferring member 24 to its ascent position, and simultaneously, the swing arm 13 is pivotally moved from its feeding position to its retracted position, and at the same time, the binder strip stand 18 is moved from its operating position to its retracted position. As a result, the binder strip stand 18 is moved out of the moving locus of the right transferring arm 35 as shown in FIG. 6(*f*).

Thereafter, the fifth pneumatic cylinder 29 is actuated, so that the binder strip transferring member 24 which holds the binder strip W2 is moved downwardly along the guide shaft 21. As a result, the binder strip transferring member 24 is positioned above the base presses 6 as shown in FIG. 6(*g*).

Then, the third pneumatic cylinder 25 is actuated for moving the binder strip transferring member 24 downwardly to obtain a binder strip releasing position. Simultaneously, the fourth pneumatic cylinder 28 is actuated for retracting the trapping needles 26 into the lower surface of the binder strip transferring member 24. Consequently, the binder strip W2 is casted on the base presses 6. Thereafter, after time elapses by a predetermined period, the folding plates 7 are actuated, so that both side edge portions of the binder strip W2 are folded into an inverted T-shape along the external configuration of the binder strip transferring member 24 as shown in FIG. 6(*h*).

Upon completion of feeding and folding the binder strip W2, CPU determines as to whether or not the flap strips W3 and W4 are prepared to be supplied in Step S9. In case of the No. 2 feeding fashion, the determination falls YES, so that in Step S10, the CPU 51 will control the preparatory device M in order to supply the right and left flap strips W3 and W4 onto the thus folded binder strip W2.

To be more specific, the CPU 51 controls the eighth and ninth pneumatic cylinders 41 and 42 for moving the transferring arms 34 and 35 and operation arms 36 and 37 from their clamping positions (FIG. 6(*b*)) to their stitch preparatory positions. Consequently, the right and left flap fabrics W3 and W4 are moved onto the folded binder strip W2 positioned on the base presses 6 as shown in FIG. 6(*i*). Next, the pneumatic cylinders 9 are actuated for moving the flap presses 8 from their standby positions shown by solid line in FIG. 2 to their operating positions shown by two dotted chain lines in FIG. 2. Accordingly, the flap strips W3 and W4 are tightly held on the base presses 6 by the flap presses 8 as shown in FIG. 6(*j*). Then, the sixth and seventh pneumatic cylinders 38 and 39 are actuated for opening the operation arms 36 and 37 with respect to the transferring arms 34 and 35, respectively, to thereby release the clamped flap strips W3 and W4 therefrom as shown in FIG. 6(*k*).

Thus, the feeding of the binder strip W2 and the flap strips W3 and W4 onto the base presses 6 is completed. While maintaining the stacking relationship among the garment W1, the binder strip W2 and the flap strips W3 and W4 by the combination of the base presses 6, the folding plates 7, the flap presses 8 and the binder strip transferring member 24, the clamp unit 5 including these presses 6 and 8 and the folding plates 7 integrally move from its preparatory position R to its stitching position S (see FIG. 1) except for the binder strip transferring member 24. At the stitching position S, the binder strip W2 and the flap strips W3 and W4 are stitched to the garment W1 by the sewing needles 4. Thereafter, each of the components constituting the preparatory device M restores its original position as shown in FIG. 6(*a*). Accordingly, the fabric feeding in accordance with the No. 2 feeding fashion and the stitching operation therefor are completed.

Next, the second feeding fashion, i.e., No. 5 feeding fashion, is to be carried out. Firstly, a new garment W1 is pressedly held on the upper surface of the sewing machine table 2 by the base presses 6. Upon depression of a start switch (not shown), the CPU 51 again performs accessing to the memory means 53 for detecting the second combination of the fabrics or strips, i.e., No. 5 feeding fashion in step S1. The CPU 52 then reads the control data corresponding to the No. 5 feeding fashion so as to control the preparatory device M in accordance with the read control data. In case of the No. 5 feeding fashion, the routine proceeds in the order of Steps S1, S2, S7, S8 and S9 shown in FIG. 7. In this routine, dispensed with are the feeding operations shown in FIGS. 6(*b*) and 6(*i*) thru 6(*k*) for feeding the right and left flap strips W3 and W4 onto the base presses 6.

Figure 7:
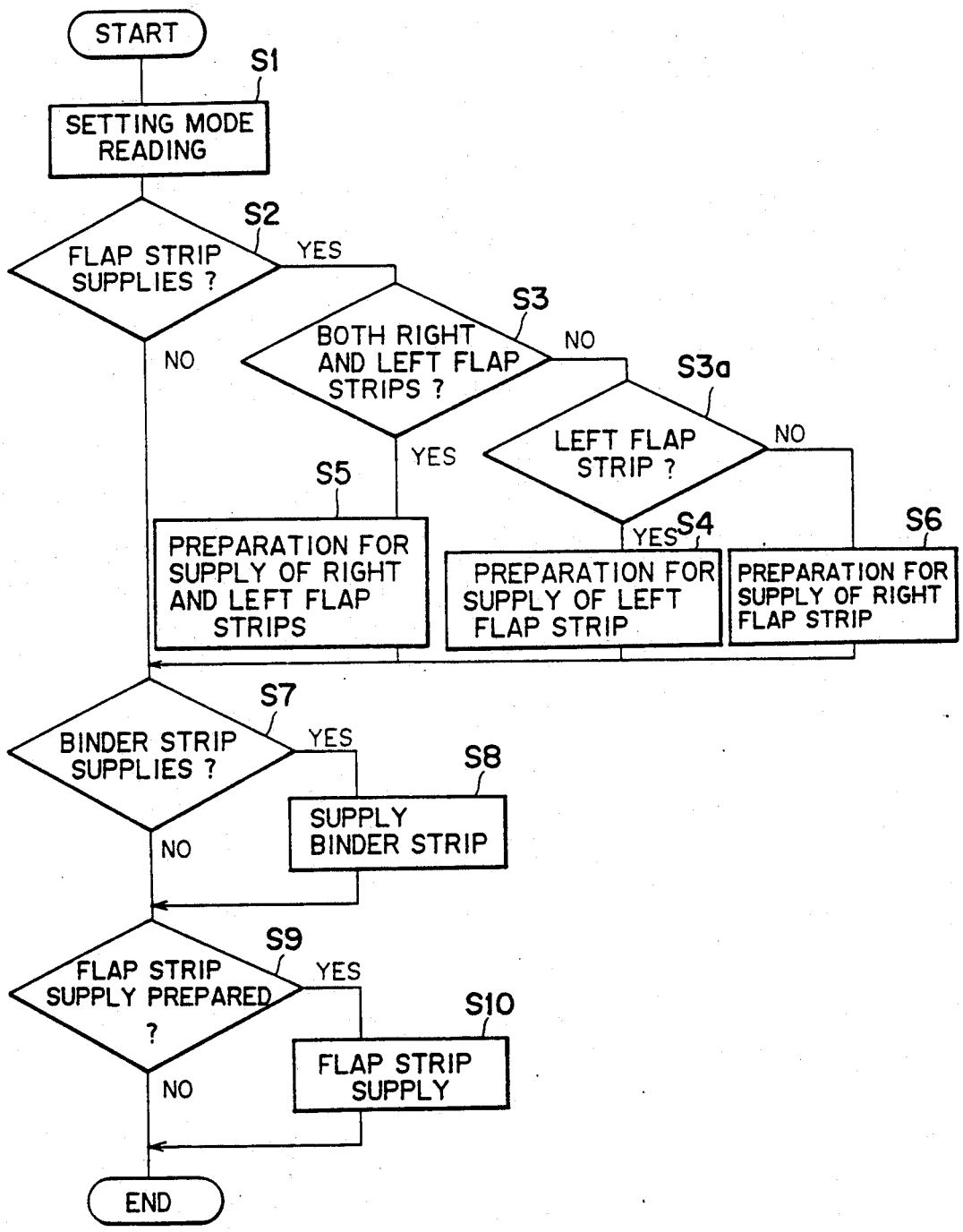
FIG. 7 is a flowchart showing an operational sequence in the embodiment of this invention.

Similarly, for performing the third feeding fashion, i.e., No. 6 feeding fashion, the routine proceeds in the order of Steps S1, S2, S3, S5, S7, S9 and S10 in FIG. 7. In this routine, dispensed with are the feeding operation shown in FIGS. 6(*c*) thru 6(*h*) for feeding the binder strip W2.

Further, for performing the fourth feeding fashion, i.e., No. 2 feeding fashion, the routine proceeds in a manner the same as that of the first feeding fashion (No. 2 feeding fashion) for feeding the binder strip W2 as well as right and left flap strips W3 and W4. After completion of the fourth feeding fashion, the first feeding fashion (No. 2 feeding fashion) is restored, since fifth feeding fashion has not been initially set by an operator. Therefore, fabric feedings are repeated in the order of No. 2, No. 5, No. 6 and No. 2 feeding fashions for effectively performing a cyclic sewing or stitching.

Incidentally, if No. 3, No. 4, No. 7 and No. 8 feeding fashions are set in which one of the right and left flap strips is not scheduled to be fed, determination is made in the CPU 51 as to whether or not both of the right and left flap strips are supplied, and the judgment falls NO in Step S3. Further, the routine proceeds into Step S3*a* in which determination is made as to whether or not left flap strip W3 is supplied. If YES, the routine proceeds into Step S4 for preparation of the supply of the left flap strip W3. If NO, the routine proceeds into Step S6 for preparation of the supply of the right flap strip W4. Then, the routine proceeds into Step S7. Furthermore, in Step S10, one of the eighth and ninth pneumatic cylinders 41 and 42 is actuated for moving one of the sets of the arms 34, 36 and arms 35 and 37 from their clamp positions to their stitch preparatory positions. Therefore, only one of the flap strips W3 and W4 is supplied onto the binder strip W2 positioned on the base presses 6 (in FIG. 6(*i*), one of the transferring arms 34 and 35 and corresponding a one of the operation arms 36 and 37 are not moved into the stitch preparatory position).

According to the foregoing embodiment, the fabric feeding device can selectively feed the binder strip W2 and the left and right flap strips W3 and W4, and various fabric feeding fashions given by the various combinations of feedings of these strips can be set in order in accordance with the desired sewing operations. Accordingly, the binder strip W2 and the left and right flap fabrics W3 and W4 can be automatically and selectively fed to the actual sewing zone in accordance with the preset feeding fashions. In other words, in the above described embodiment, it is unnecessary to newly set a feeding fashion with respect to the strips W2, W3 and W4 after every termination of stitching in accordance with the previous feeding fashion. In the present embodiment, various feeding fashions with respect to these strips W2, W3 and W4 are provisionally set, for example, five kinds of feeding fashions can be initially set. After setting these feeding fashions, the feeding of the strips W2, W3, W4 and stitching operations therefor can be made in accordance with the sewing execution programs per each of the feeding fashions. Therefore, effective supply of the binder strip and the flap strips is achievable, and cyclical sewing can be performed with reduced operational dead time.

While the invention has been described in detail and with reference to specific embodiment thereof, it would be apparent to those skilled in the art that various changes and modifications can be made therein without departing from the spirit and scope of the invention.

What is claimed is:

1. A workpiece fabric feeding device for use in a binder strip sewing machine, the sewing machine including a table (2) on which a garment (W1) is held, and a stitching mechanism for stitching at least one of a binder strip (W2) and flap strips (W3, W4) selectively fed by the workpiece fabric feeding device to the garment (W1), the workpiece fabric feeding device comprising;

a preparatory device (M) for independently positioning at least one of the binder strip (W2) and the flap strips (W3, W4) onto a predetermined position of the garment (W1) and for integrally feeding the garment (W1) and the at least one of the binder strip (W2) and the flap strips (W3, W4) to the stitching mechanism;

setting means (52) for setting a plurality of feeding fashions defined by combinations of the binder strip and flap strips; and control means (51, 53) for controlling the preparatory device (M) in order to execute sewing programs in accordance with the feeding fashions set in the setting means.

2. The workpiece fabric feeding device as claimed in claim 1, wherein the preparatory device (M) comprises;

a clamp unit (5) movable between its stitch preparatory position (R) and its actual stitching position (S) on the table (2);

a swing arm (13) provided pivotally movable between a standby position and an operating position for selectively supplying the binder strip (W2) to the clamp unit (5);

a binder strip stand (18) connected to the swing arm (13) for mounting the binder strip (W2) on the stand (18);

a binder strip transferring member (24) confrontable with the binder strip stand (18) for holding the binder strip on the binder strip stand, and for carrying the binder strip to the clamp unit;

a pair of transferring arms (34, 35) provided pivotally movable between clamping positions for clamping the flap strips and releasing positions for releasing the flap strips;

a pair of operation arms (36, 37) pivotally connected to the transferring arms (34, 35) for clamping one of the flap strips between one of the transfer arms (34) and one of the operation arms (36) and for clamping the other flap strip between the other transfer arm (35) and the other operation arm (37); and a plurality of drive means, each one of the drive means being connected to each one of the clamp unit, the binder strip stand, the binder strip transferring member, the pair of transferring arms, and the pair of operation arms for driving the connected component.

3. The workpiece fabric feeding device as claimed in claim 1, wherein the control means comprises;

a central processing circuit (51) having an output side connected to each of the drive means, and having an input side connected to the setting means; and a memory means (52) storing therein data of operation timings of the plurality of drive means in response to the feeding fashions set by the setting means and having a memory region for storing therein an order of the feeding fashions set by the setting means, the memory means being accessibly connected to the central processing unit.

4. The workpiece fabric feeding device as claimed in claim 1, wherein the flap strips comprise a first flap strip and a second flap strip, and the control means comprises;

means for accessing the feeding fashion set by the setting means;

a first judging means for judging a necessity for a supply of the first flap strip;

a first means for sending a signal indicative of preparing a supply of the first flap strip if the first judging means judges the necessity for supply of the first flap strip;

a second judging means for judging a necessity for supply of the binder strip;

a second means for sending a signal indicative of a supply of the binder strip;

a third judging means for judging a necessity for a supply of the second flap strip; and a third means for sending a signal indicative of preparing a supply of the second flap strip.

* * * * *